US010158154B2

(12) United States Patent
Tkadlec et al.

(10) Patent No.: US 10,158,154 B2
(45) Date of Patent: Dec. 18, 2018

(54) MICROWAVE FILTER HAVING A FINE TEMPERATURE DRIFT TUNING MECHANISM

(71) Applicant: Andrew Wireless Systems GmbH, Buchdorf (DE)

(72) Inventors: Roman Tkadlec, Pardubice (CZ); Frantisek Hrnicko, Pardubice (CZ); Gabriel Toth, Pardubice (CZ)

(73) Assignee: Andrew Wireless Systems GmbH, Buchdorf (DE)

( * ) Notice: Subject to any disclaimer, the term of this patent is extended or adjusted under 35 U.S.C. 154(b) by 0 days.

(21) Appl. No.: 15/115,614

(22) PCT Filed: Jan. 19, 2015

(86) PCT No.: PCT/EP2015/050863

§ 371 (c)(1),
(2) Date: Jul. 29, 2016

(87) PCT Pub. No.: WO2015/113845

PCT Pub. Date: Aug. 6, 2015

(65) Prior Publication Data

US 2017/0170535 A1 Jun. 15, 2017

(30) Foreign Application Priority Data

Jan. 31, 2014 (EP) ..... 14153464

(51) Int. Cl.
*H01P 1/205* (2006.01)
*H01P 1/208* (2006.01)
(Continued)

(52) U.S. Cl.
CPC ..... *H01P 1/2053* (2013.01); *H01P 1/208* (2013.01); *H01P 1/2084* (2013.01); *H01P 1/30* (2013.01); *H01P 7/04* (2013.01)

(58) Field of Classification Search
CPC ..... H01P 1/208; H01P 1/2084; H01P 1/30; H01P 7/04; H01P 7/06; H01P 1/2053
(Continued)

(56) References Cited

U.S. PATENT DOCUMENTS 3,733,567 A * 5/1973 Johnson ..... H01P 7/04 333/226
4,156,860 A * 5/1979 Atia ..... H01P 7/06 333/228

(Continued)

FOREIGN PATENT DOCUMENTS

AU 5257764 6/1967
CN 101964436 A 2/2011

(Continued)

OTHER PUBLICATIONS

International Search Authority, "International Search Report and Written Opinion for PCT Application No. PCT/EP2015/050863", dated Apr. 21, 2015, pp. 1-12, Published in: WO.

(Continued)

*Primary Examiner* — Rakesh Patel
(74) *Attorney, Agent, or Firm* — Fogg & Powers LLC

(57) ABSTRACT

A microwave filter comprises at least one resonant filter element resonating at a resonant frequency and having a housing, a resonant filter cavity arranged in the housing and a resonator element arranged in the housing. At least two tuning elements are arranged on the housing of the resonant filter element and each extend into the cavity with a shaft portion, wherein the two tuning elements are movable with respect to the housing to adjust the length of the shaft portion extending into the housing and wherein the at least two tuning elements are constituted and designed such that by adjusting the length of the shaft portion of each tuning
(Continued)

element extending into the housing a temperature drift of the resonant frequency is adjustable.

6 Claims, 7 Drawing Sheets

(51) Int. Cl.
*H01P 1/30* (2006.01)
*H01P 7/04* (2006.01)

(58) Field of Classification Search
USPC ..... 333/223, 224, 234
See application file for complete search history.

(56) References Cited

U.S. PATENT DOCUMENTS

| | | | | |
|---|---|---|---|---|
| 4,639,699 | A | 1/1987 | Nishikawa et al. | |
| 6,362,708 | B1 | 3/2002 | Woods | |
| 6,611,183 | B1 * | 8/2003 | Peters | H01P 1/2053 333/203 |
| 2005/0040916 | A1 * | 2/2005 | Park | H01P 1/205 333/203 |
| 2011/0115575 | A1 * | 5/2011 | Wong | H01P 1/2053 333/203 |
| 2013/0229243 | A1 * | 9/2013 | Mobbs | H01P 7/04 333/202 |

FOREIGN PATENT DOCUMENTS

| | | |
|---|---|---|
| DE | 2740294 | 3/1979 |
| EP | 0188367 | 7/1986 |
| EP | 0247440 | 12/1987 |

OTHER PUBLICATIONS

Cameron et al., "Synthesis of Advanced Microwave Filters Without Diagonal Cross-Couplings", "2002 IEEE MTT-S International Microwave Symposium Digest", Dec. 12, 2002, pp. 2862-2872, vol. 50, No. 12, Publisher: IEEE.

Keats et al., "Shape Memory Alloy Temperature Compensation for Resonators", "2003 IEEE MTT-S Interantional Microwave Symposium Digest", Jun. 8, 2003, pp. 1259-1262, Publisher: IEEE, Published in: Philadelphia, PA.

Wang et al., "Temperature Compensation of Combline Resonators and Filters", "Microwave Symposium Digest, 1999 IEEE MTT-S International", Jun. 13, 1999, pp. 1041-1044, vol. 3, Publisher: IEEE, Published in: Anaheim, CA.

European Patent Office, "Communication Pursuant to Article 94(3) for EP Application No. 14153464.4", "Foreign Counterpart to U.S. Appl. No. 15/115,614", dated Jan. 2, 2018, pp. 15, Published in: EP.

State Intellectual Property of the People's Republic of China, First Office Action for CN Application No. 201580011251.2 dated Apr. 24, 2018, "Foreign Counterpart to U.S. Appl. No. 15/115,614", filed Apr. 24, 2018, pp. 1-9, Published in: CN.

* cited by examiner

MICROWAVE FILTER HAVING A FINE TEMPERATURE DRIFT TUNING MECHANISM

CROSS-REFERENCE TO RELATED APPLICATIONS

This application is a U.S. National Stage application of PCT Application Serial No. PCT/EP2015/050863, filed Jan. 19, 2015, which claims the benefit of EP Patent Application Serial No. 14153464.4, filed Jan. 31, 2014, the contents of all of which are hereby incorporated by reference.

DESCRIPTION

The invention relates to a microwave filter according to the preamble of claim 1.

A microwave filter of this kind comprises one or multiple resonant filter elements resonating at a resonant frequency and having a housing, a resonant filter cavity arranged in the housing and a resonator element arranged in the housing.

Such microwave filters are for example employed in wireless communication and may for example realize a bandpass or bandstop filter. In this regard, continuous growth in wireless communication in recent decades has caused more advanced, stricter requirements on filters and on other equipment in a communication system. In particular, filters with a narrow bandwidth, a low insertion loss and a high selectivity are required, wherein such filters must be operable in a wide temperature range. In general, filters must operate at low temperatures in cold environments as well as at elevated temperatures for example after warming of components of a communication system during operation.

To fulfill such requirements, typically microwave filters with a multiplicity of a resonant filter elements, in particular resonant filter cavities, electromagnetically coupled to each other are used. In such filters, in order to fulfill required specifications in a wide operational temperature range, a mechanism is required to stabilize a resonant frequency against a temperature drift. For this, a housing and a resonator element, for example a resonator rod, of a filter element may be made of materials with different coefficients of thermal expansion (CTE) in order to stabilize the resonant frequency of the entire filter. Such temperature compensation however is rather coarse. It results in a reduced temperature drift of the whole filter, but filter performance may degrade considerably due to differences among temperature drifts of individual resonant elements caused by batch-to-batch material and mechanical tolerances. Those differences are hardly predictable and can be minimized by individual compensation of each resonant element of each filter only.

In addition, typically such resonant frequency temperature compensation is based on the assumption that all resonant filter elements of the filter resonate at the same frequency. This typically may not be true because as a result of filter synthesis each resonant filter element of a filter may resonate at a slightly different frequency. Consequently, different resonant filter elements may have a different resonant frequency drift caused by temperature variations, possibly resulting in a degradation of filter performance.

Recently proposed topologies called cul-de-sac having a minimum number of couplings for a given response and no diagonal couplings typically are even more temperature sensitive than conventional topologies and require a very precise temperature compensation to profit from their advantages.

There consequently is a need for a method to allow a fine temperature compensation at each single resonant filter element in order to compensate for assembly, mechanical and material tolerances and different loading. It in general can be assumed that a filter response can be considered as temperature compensated when all of its resonant filter elements are reasonably well temperature compensated.

Temperature compensated filters may for example employ materials with a low thermal expansion coefficient, for example so called Invar materials. Such materials however are costly. Another option is to combine different materials having suitable thermal expansion coefficients.

Cost-effective coaxial resonator cavities may for example employ a housing of an aluminum alloy comprising a resonator element and a tuning screw made of brass or steel. By computer simulation the dimensions of a resonant cavity may be determined so that the cavity is compensated against frequency drift at its nominal resonator dimensions, at the nominal values of the thermal expansion coefficient and at its nominal frequency. Due to production variances and mechanical and material tolerances, however, different resonant cavities may exhibit different resonant frequency temperature drifts deviating from the nominal resonant frequency temperature drift. This impacts the performance of the overall filter, leading to a degradation in filter performance.

In general, a temperature compensation of a single resonant filter element or of several separate resonant filter elements coupled to a main microwave line is simple and straight forward because the frequency drift of each resonant filter element caused by temperature changes is separated from other resonant filter elements, such that the effects of tuning can be clearly distinguished for the different resonant filter elements. However, more complicated situations occur when multiple resonant filter elements are crossed-coupled, in particular for cul-de-sac topologies in which it by means of currently known technics it is practically impossible to distinguish a frequency drift of the particular resonant filter elements from the overall filter response.

The synthesis of microwave filters, in particular microwave cavity filters employing a cul-de-sac topology, is for example described in articles for example by Cameron et al., "Synthesis of advanced microwave filters without diagonal cross-couplings", IEEE Trans. MTT, Vol. 50, No. 12, December 2002; by Fathelbab, "Synthesis of cul-de-sac filter networks utilizing hybrid couplers", IEEE Microwave and Wireless Components Letters, Vol. 17, No. 5, May 2007; and by Corrales et al., "Microstrip dual-band bandpass filter based on the cul-de-sac topology", Proceedings of the 40. European Microwave Conference, September 2010. In an article by Wang et al., "Temperature compensation of combline resonators and filters", IEEE MTT-S Digest, 1999 a method for temperature compensation of a resonator is modeled, the resonator comprising a tuning screw and a resonator rod being cylindrical in shape and being arranged in a cavity.

From U.S. Pat. No. 6,734,766 a microwave filter having a temperature compensating element is known. The microwave filter includes a housing wall structure, a filter lid, a resonator rod, a tuning screw and a temperature compensating element. The temperature compensating element is joined to the filter lid or the housing and forms a bimetallic composite with the filter lid or housing that deforms with a changed in ambient temperature.

From U.S. Pat. No. 5,233,319 a dielectric resonator is known which comprises two tuning screws, one of which is metallic and the other one of which is dielectric. The two tuning screws are movable with respect to a housing, wherein by moving the metallic tuning screw into the housing a resonant frequency of the resonator can be tuned up, whereas by moving the dielectric tuning screw into the housing a resonant frequency of the resonator may be lowered.

It is an object of the instant invention to provide a microwave filter which allows in an easy way for a tuning in order to finely compensate for a temperature drift.

This object is achieved by a microwave filter having the features of claim 1.

Accordingly, at least two tuning elements are arranged on the housing of the resonant filter element and each extend into the cavity with a shaft portion, wherein the two tuning elements are movable with respect to the housing to adjust the length of the shaft portion extending into the housing and wherein the at least two tuning elements are constituted and designed such that by adjusting the length of the shaft portion of each tuning element extending into the housing the temperature drift of the resonant frequency is adjustable.

This is based on the idea to provide a tuning mechanism having two separate tuning elements which are arranged on the housing of the filter element and are movable with respect to a housing wall such that they can be adjusted in their longitudinal position with respect to the associated housing wall. Such tuning elements each extend into the cavity of the filter element with a shaft portion, wherein by moving the tuning elements the length of the shaft portion extending into the cavity may be adjusted.

Herein, the tuning elements are provided and designed such that they allow for a compensation of a temperature drift at a resonant frequency. In other words, by adjusting the two tuning elements in an appropriate manner, the resonant frequency of the resonant filter element may be kept constant, but the temperature drift may be adjusted such that, in the optimal case, a zero or at least minimum temperature drift is obtained at the desired resonant frequency.

In particular, the two tuning elements may have a different temperature dependence such that they have an opposite effect on the temperature drift of the resonant frequency. Namely, at a given adjustment position, a first of the at least two tuning elements may have the effect of increasing the resonant frequency with increasing temperature of the microwave filter, whereas a second one of the at least two tuning elements, at a given adjustment position, has the effect of decreasing the resonant frequency with increasing temperature of the microwave filter. Hence, if temperature increases, one of the tuning elements has a tendency to lower the resonant frequency of the resonant filter element, whereas the other filter element has the tendency to increase the resonant frequency. In combination, hence their effects may cancel out such that by properly adjusting the tuning elements a temperature drift of the resonant frequency may be compensated.

It is conceivable that the tuning elements are movable with respect to the housing in a coupled manner such that the moving of one of the tuning elements into the cavity automatically causes a moving of another tuning element out of the cavity. However, beneficially the tuning elements are movable with respect to the housing independent of each other.

The at least two tuning elements may for example be arranged symmetrically with respect to a resonant element, for example a resonator rod, arranged in the housing. The resonator element is for example arranged centrally in a cavity of the resonant filter element and comprises a plane of symmetry extending along the longitudinal axis of the resonator element. Two tuning elements in this regard may be arranged symmetrically to the plane of symmetry such that they symmetrically are placed at either side of the plane of symmetry.

For example, in such symmetrical arrangement each tuning element may extend into an opening of the resonator element. Just as well, the two tuning elements may be displaced from the resonator such that they do not extend into an opening of the resonator element.

In another arrangement, the at least two tuning elements may be arranged asymmetrically with respect to the resonator element. Herein, at least one of the tuning elements may for example extend into an opening of the resonator element. In such asymmetrical arrangement, one tuning element may extend along the longitudinal axis of the resonator element, for example a cylindrical resonator rod, whereas another tuning element is arranged at a displaced location on the housing of the resonant filter element.

When two tuning elements are arranged symmetrically on the housing of the filter element, such tuning elements necessarily must comprise a different material and/or shape in order to be able to compensate for a temperature drift. Herein, in order to compensate for a temperature drift, one tuning element may for example be moved out of the cavity of the filter element while moving the other tuning element into the cavity of the filter element such that the resonant frequency is maintained at a desired value, but the temperature drift is altered. The tuning elements may be made, for example, of a metal such as brass, steel or an aluminium alloy. Or they may be made of a dielectric material.

When the tuning elements are placed asymmetrically on the housing of the filter element, they, in principle, may have the same material and shape. Even for an asymmetrical arrangement, however, it may be beneficial to have two or more tuning elements of different material and/or shape. Again, the tuning elements may be made, for example, of a metal such as brass, steel or an aluminium alloy. Or they may be made of a dielectric material.

In particular, when using two tuning elements having different materials, the adjusting of such materials beneficially shall cause a resonant frequency temperature drift of different signs, thus allowing for temperature drift in a rather wide range by adjusting the two tuning elements in a prescribed manner.

In a specific embodiment of a microwave filter the resonator element is arranged on a bottom wall of the cavity and extends into the cavity along a longitudinal direction. The at least two tuning elements in this case preferably are each arranged on a side wall extending at an angle, for example vertical, from the bottom wall or on a top wall opposite the bottom wall of the cavity. The resonator element, at a top face facing the top wall, may comprise at least one opening into which at least one of the at least two tuning elements extends, the at least one opening extending from the top face along the longitudinal direction into a shaft body of the resonator element.

The idea underlining the invention shall subsequently be described in more detail with respect to the embodiments shown in the figures. Herein:

Figure 1A:
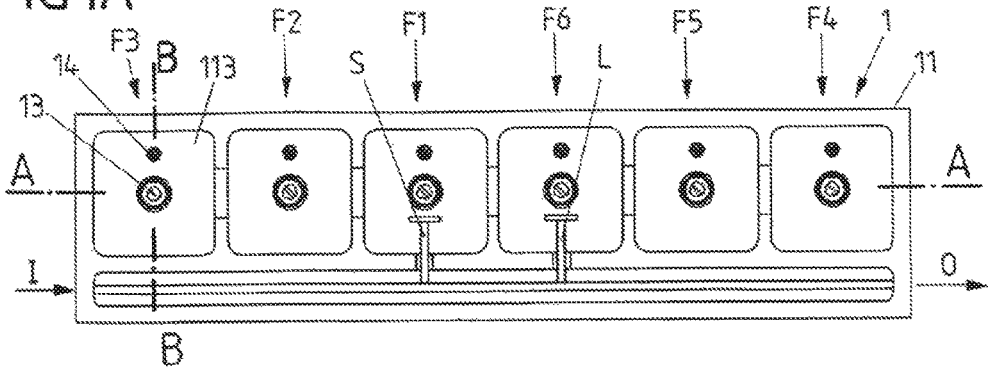
FIG. 1A shows a top view of a microwave filter comprising a multiplicity of resonant filter elements in the shape of microwave cavities.
Figure 1B:
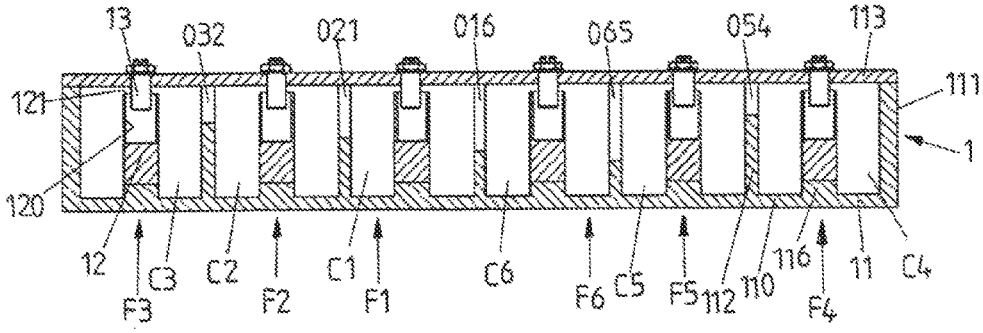
FIG. 1B shows a sectional view of the microwave filter along line A-A according to FIG. 1A.

FIGS. 1A and 1B show a microwave filter 1 being constituted as a microwave cavity filter. The microwave filter 1 comprises a multiplicity of resonant filter elements F1-F6 each having one resonant microwave cavity C1-C6. The microwave filter 1 may for example realize a bandstop filter having a predefined stopband or a bandpass filter having a predefined passband.

The cavities C1-C6 of the filter elements F1-F6 of the microwave filter 1 are formed by a wall structure 110-115 of a housing 11 of the microwave filter 1. The housing 11 comprises a bottom wall 110 from which side walls 111, 112, 114, 115 (see FIGS. 1B and 3) extend vertically. The housing 11 further comprises a lid forming a top wall 113 covering the microwave filter 1 at the top.

The cavities C1-C6 of neighbouring filter elements F1-F6 are connected to each other via openings O32, O21, O16, O65, O54 in the wall structure separating the different cavities C1-C6 such that neighbouring cavities C1-C6 are electromagnetically coupled. The microwave filter 1 has a so called cul-de-sac topology in that the filter elements F1-F6 are arranged in a row and a coupling to a mainline M is provided at the two inner most filter elements F1, F6 (source S and load L). A microwave signal hence may be coupled via an input I into the mainline M, is coupled into the microwave filter 1 and is output at an output O.

Each resonant filter element F1-F6, in its filter cavity C1-C6, comprises a resonator element 12 extending from an elevation 116 on the bottom wall 110 into the cavity C1-C6 such that the resonator element 12, for example formed as a rod having a circular or quadratic cross-section, centrally protrudes into the cavity C1-C6.

Generally, the resonant frequency of a resonant filter element F1-F6 is determined by the dimensions of the cavity C1-C6 and the resonator element 12 arranged in the cavity C1-C6. In order to be able to tune the resonant frequency of the filter elements F1-F6, herein on each resonant filter element F1-F6 a tuning element 13 in the shape of a tuning screw is provided. The tuning element 13 is arranged on a top wall 113 of the corresponding cavity C1-C6 and comprises a shaft portion 132 which may be moved into or out of the cavity C1-C6 in order to adjust the resonant frequency of the corresponding resonant filter element F1-F6.

The resonant frequencies of the single resonant filter elements F1-F6 in combination then determine the resonant behaviour of the overall microwave filter 1 and hence the shape of e.g. a passband or a stopband.

Figure 2:
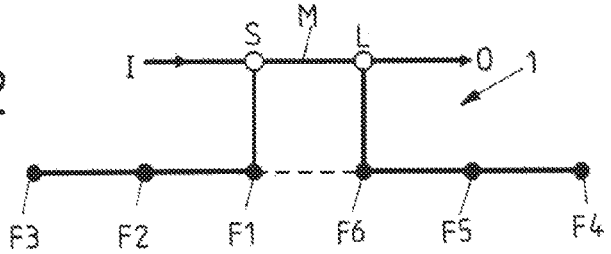
FIG. 2 shows a schematic functional drawing of the microwave filter.

A schematic view of the microwave filter 1 indicating the functional arrangement of the single resonant filter elements F1-F6 is shown in FIG. 2, depicting the coupling between the filter elements F1-F6 and the mainline M.

Figure 3:
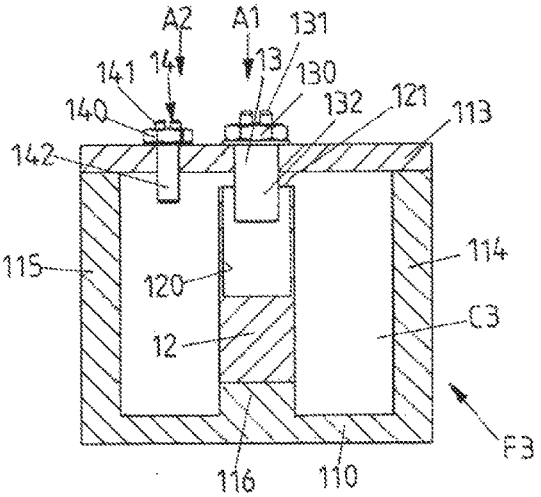
FIG. 3 shows a sectional view along line B-B according to FIG. 1A.

As shown in FIG. 3, each resonant filter element F1-F6 in the instant example comprises, in addition to the first tuning element 13, a second tuning element 14 having a shaft portion 142 extending into the corresponding cavity C1-C6. The tuning elements 13, 14 together make up a tuning mechanism which allows on the one hand for the tuning of the resonant frequency of the associated filter element F1-F6 and on the other hand for a compensation of the temperature drift of the resonant filter element F1-F6 in order to obtain a favourable temperature behaviour of the resonant filter element F1-F6.

As shown in FIG. 3, each tuning element 13, 14 comprises a shaft portion 132, 142 extending into the corresponding cavity C1-C6 of the filter element F1-F6. Outside of the cavity C1-C6 a head 131, 141 of the tuning element 13, 14 is placed via which a user may act onto the tuning element 13, 14 to screw it into or out of the cavity C1-C6. The tuning elements 13, 14 are held on the top wall 113 by means of a nut 131, 141. The tuning elements 13, 14 are movable with respect to the top wall 113 of the housing 11 of the filter element F1-F6 along an adjustment direction A1, A2 and each are formed as a screw such that by turning the respective tuning element 13, 14 about its adjustment direction A1, A2 a longitudinal adjustment along the corresponding adjustment direction A1, A2 is obtained. By means of such longitudinal adjustment, the length of the shaft portion 132, 142 of the tuning element 13, 14 extending into the cavity C1-C6 can be varied.

In general, a temperature drift compensation of a single resonant filter element F1-F6 which is not coupled to any other resonant filter elements F1-F6 and hence can be regarded separately from other filter elements F1-F6 is rather easy. However, for a multiplicity of filter elements F1-F6 cross-coupled to each other as for example in the microwave filter 1 of FIGS. 1A and 1B, such compensation is not possible in an easy and intuitive manner. Temperature drift related to each resonant filter element F1-F6 shall be determined and a related tuning mechanism 13, 14 of a single resonant filter element F1-F6 shall be adjusted accordingly in order to obtain a favourable temperature drift compensation of the overall microwave filter 1.

Figure 4A:
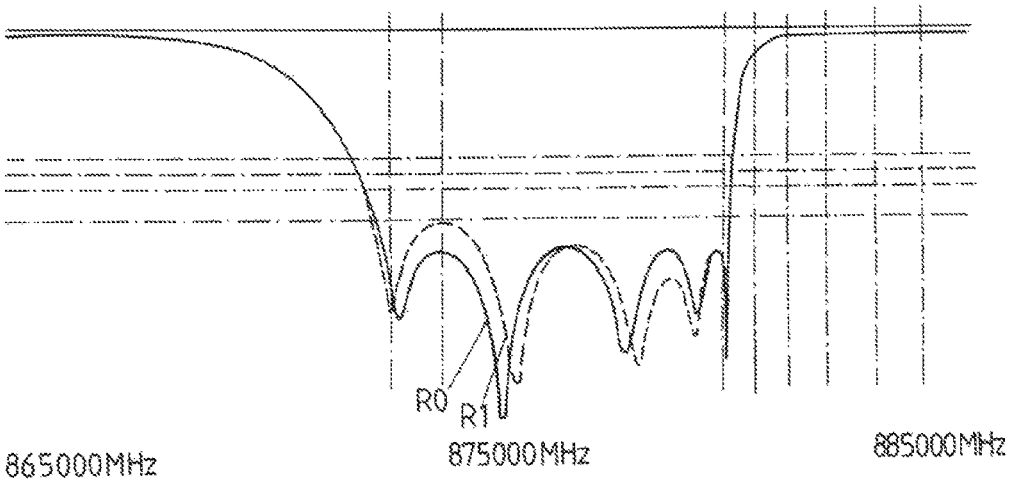
FIG. 4A shows a measured frequency response of a microwave filter, before temperature drift compensation.
Figure 4B:
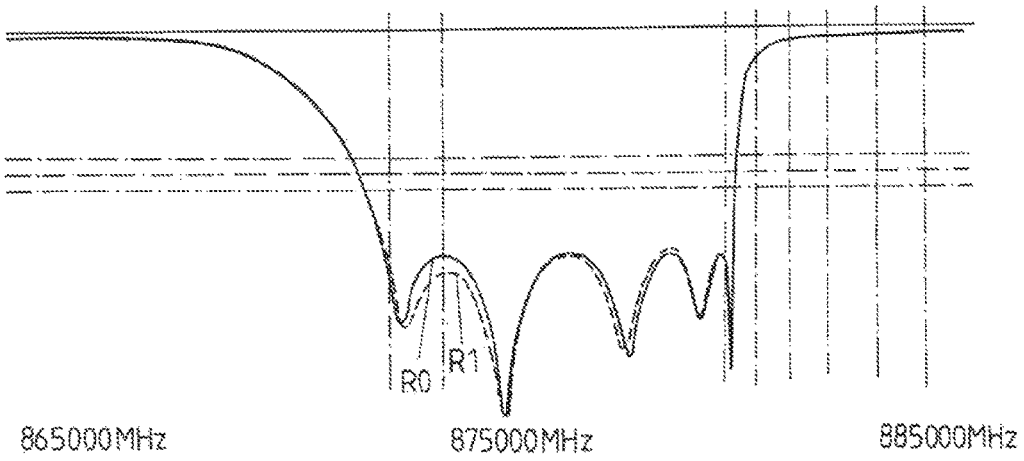
FIG. 4B shows a measured frequency response of a microwave filter, after temperature drift compensation.

If the temperature drift of each resonant filter element F1-F6 is compensated appropriately, also the overall microwave filter 1 will exhibit a behavior having a desired (minimum) temperature drift. This is shown in FIGS. 4A and 4B depicting the measured frequency response R0 at room temperature and the measured frequency response R1 at an elevated temperature first for a non-compensated filter 1 (FIG. 4A) and second for a compensated filter 1 (FIG. 4B). In the compensated state the curves at room temperature and at the elevated temperature are almost matched to each other.

Figure 5:
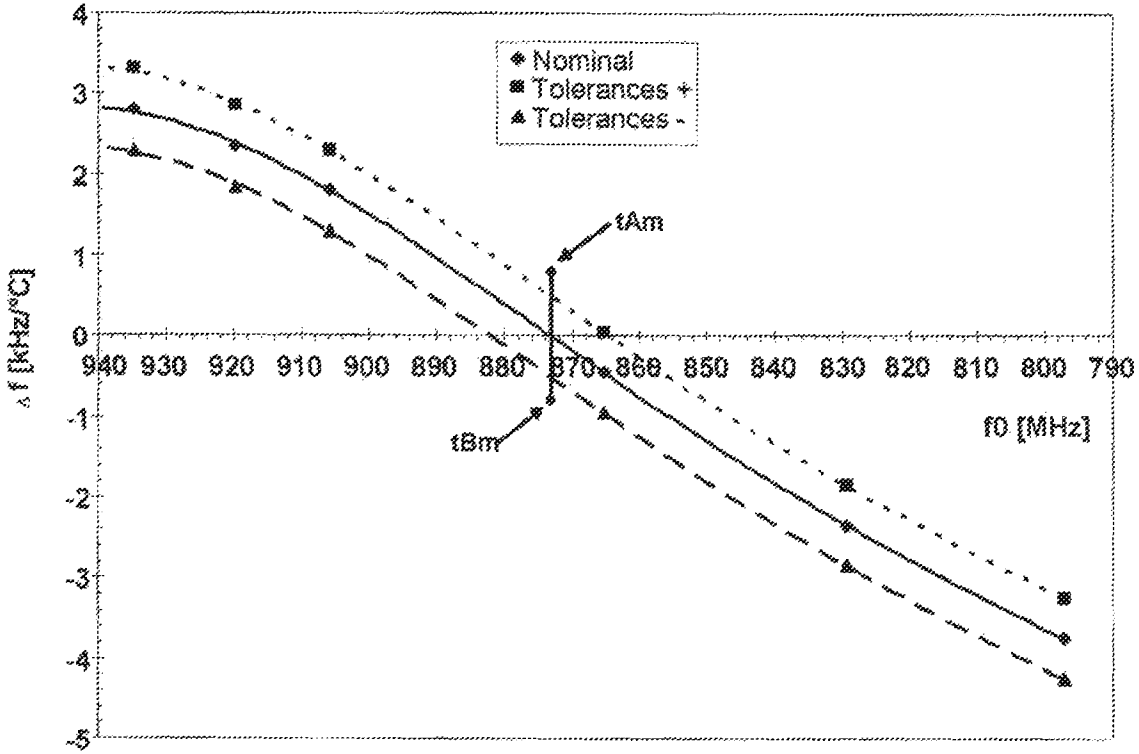
FIG. 5 shows a diagram of a temperature drift.

FIG. 5 shows a graph of a temperature drift, i.e. the dependence of the frequency shift per ° C. (vertical axis) in dependence of the resonant frequency (horizontal axis). As visible, when the microwave filter 1 is perfectly compensated at its nominal resonant frequency (in the example at about 873.5 MHz), the resonant frequency does not change with temperature ($\Delta f=0$). This is indicated by the solid line in FIG. 5, which crosses the horizontal axis at the nominal resonant frequency.

However, due to tolerances in the dimensions of the cavities C1-C6, in its materials and the like the actual temperature drift may differ from the ideal temperature drift. This is indicated by the dashed line below the solid line and the dotted line above the solid line indicating an influence of tolerances on the temperature drift. It thus can be seen that, due to tolerances, at the nominal resonant frequency the temperature drift may lie above or below zero.

Figure 6A:
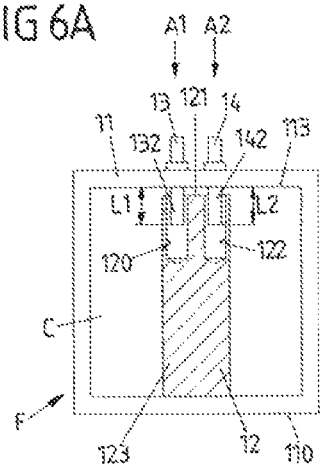
FIG. 6A shows an embodiment of a resonant filter element having a tuning mechanism for compensating a temperature drift.
Figure 6B:
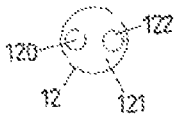
FIG. 6B shows a top view of a resonator element used in the resonant filter element of FIG. 6A.

In order to compensate for the temperature drift and in order to tune a resonant filter element F with its cavity C such that at the nominal resonant frequency a temperature drift of approximately zero is obtained, in the embodiment of FIG. 6A, 6B a tuning mechanism is provided comprising two tuning elements 13, 14 in the shape of tuning screws which are symmetrically arranged on a top wall 113 of the housing 11 of the filter element F and can be adjusted each along an associated adjustment direction A1, A2 to adapt a length L1, L2 of a shaft portion 132, 142 extending into the cavity C.

In the shown embodiment the tuning elements 13, 14 are arranged symmetrically with respect to a resonator element 12 in the shape of a resonator rod arranged on a bottom wall 110 of the housing 11. The resonator element 12 comprises a symmetry plane P corresponding to a central symmetry plane of the cavity C. The two tuning elements 13, 14 are arranged symmetrically on either side of the symmetry plane P.

Furthermore, the tuning elements 13, 14 each extend into an opening 120, 122 which extends into a shaft body 123 of the resonator element 12 from a top face 121 of the resonator element 12 facing the top wall 113 of the cavity C. Each tuning element 13, 14 can be adjusted along its longitudinal adjustment direction A1, A2 such that they can be moved within the respective associated opening 120, 122 of the resonator element 12.

A top view of the resonator element 12 showing the top face 121 with the openings 120, 122 arranged thereon is shown in FIG. 6B.

In the embodiment, the tuning elements 13, 14 have different materials and for example have thermal expansion coefficients of different signs. For example, one tuning element 13, 14 may be made of brass, whereas the other tuning element 14, 13 is made of an aluminum alloy. Other combinations are of course possibly and can be chosen as suitable.

Figure 7:
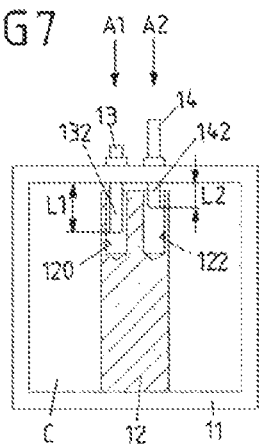
FIG. 7 shows the view of FIG. 6A, with two tuning elements of the tuning mechanism being adjusted to obtain a temperature drift compensation.

As shown in FIG. 7, to maintain the resonant filter element F at its nominal resonant frequency, but to at the same time compensate for a temperature drift, one of the tuning elements 13, 14 with its shaft portion 132, 142 may be moved out of the cavity C in order to reduce the length L1, L2 of the shaft portion 132, 142 extending into the cavity C, whereas the other tuning element 13, 14 may be moved into the cavity C. In the depicted example, the tuning element 13 is adjusted such that the length L1 of the shaft portion 132 extending into the opening 120 of the resonator element 12 is increased, whereas the length L2 of the shaft portion 142 of the other tuning element 14 is decreased. In this way, the resonant frequency of the resonant filter element F can be kept the same, while the temperature drift, i.e. the change of the resonant frequency with temperature, can be adjusted.

Figure 8:
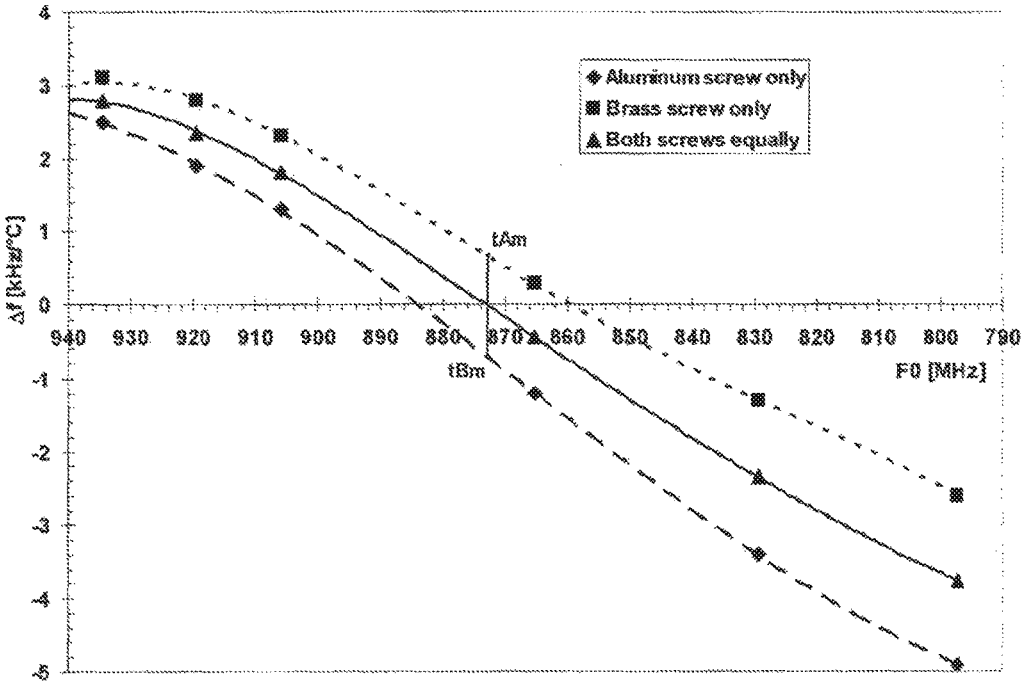
FIG. 8 shows temperature drift curves dependent on an adjustment of tuning elements in a resonant filter element.

This is shown graphically in FIG. 8. Herein, if it is assumed that one tuning element 13, 14 is made of brass and the other tuning element 14, 13 is made of an aluminum alloy, by adjusting one or the other tuning element 13, 14 the temperature drift may be increased or decreased. The graphical representation of FIG. 8 for example is a result of simulation and provides an indication about what tuning element 13, 14 should be adjusted by what amount in order to obtain a desired temperature drift compensation effect.

Figure 9A:
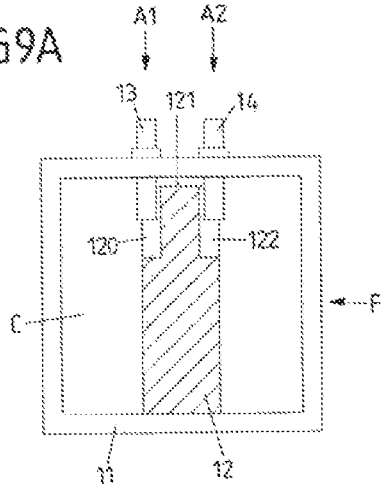
FIG. 9A shows a view of another embodiment of a resonant filter element having a tuning mechanism.
Figure 9B:
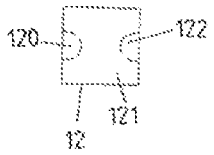
FIG. 9B shows a top view of a resonator element used in the resonant filter element of FIG. 9A.

FIGS. 9A and 9B show another embodiment of a filter element F having a tuning mechanism comprising two symmetrically arranged tuning elements 13, 14. In this example, the resonator element 12 has a quadratic cross section (FIG. 9B) and the openings 120, 122 are formed as groove-like recesses in side faces of the resonator element 12.

Figure 10:
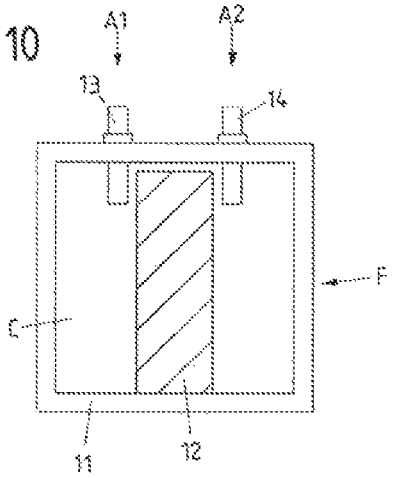
FIG. 10 shows a view of another embodiment of a tuning mechanism in a resonant filter element.

In the example of FIG. 10, a tuning mechanism comprising two symmetrically arranged tuning elements 13, 14 is provided, wherein the tuning elements 13, 14 do not extend into openings of the resonator element 12.

In general, if a tuning mechanism comprising two symmetrically arranged tuning elements 13, 14 is provided, such tuning elements 13, 14 must be different in their shape and/or material in order to allow for a temperature drift compensation.

Symmetrically arranged tuning elements 13, 14 do not necessarily have to be arranged on the top wall 113, but may be arranged also on opposite sidewalls 111, 112, 114, 115.

Figure 11:
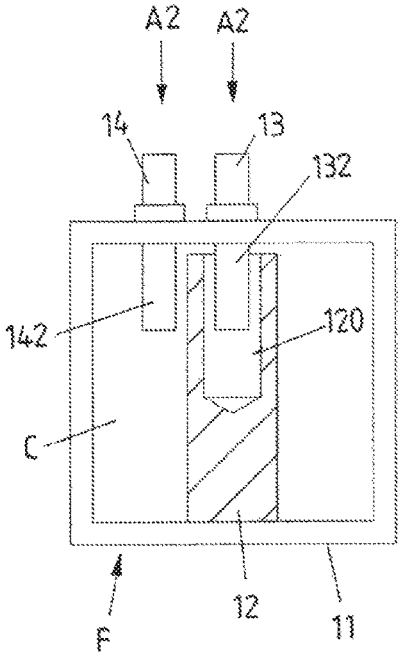
FIG. 11 shows a view of yet another embodiment of a resonant filter element having a tuning mechanism.
Figure 12:
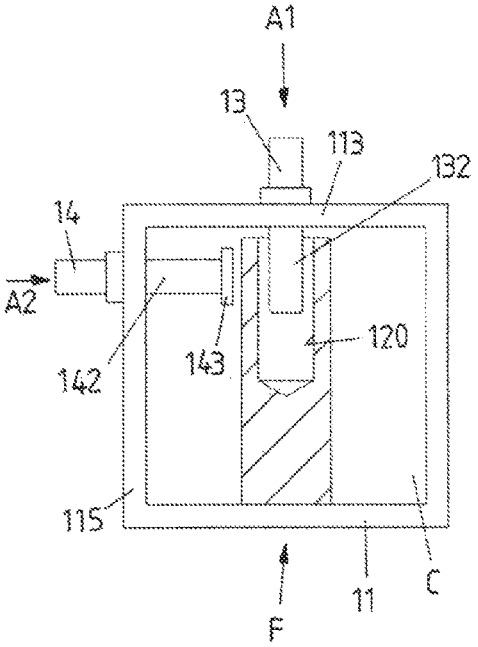
FIG. 12 shows a view of yet another embodiment of a resonant filter element having a tuning mechanism.

In principle it is also possible to arrange two tuning elements 13, 14 in an asymmetrical manner on the housing 11 of a filter element F, as is shown in different embodiments in FIGS. 11 and 12. In this regard the tuning elements 13, 14 do not necessarily have to be arranged on the top wall 113 of the housing 11, but at least one of the tuning elements 13, 14 may also be arranged on a side wall 115.

If an asymmetrical arrangement of the tuning elements 13, 14 is used, the tuning elements 13, 14 do not necessarily have to be different in their shape or size, but may also be identical. Different effects of the tuning elements 13, 14 onto the temperature drift in such embodiments may be provided by the asymmetrical arrangement of the tuning elements 13, 14.

The idea underlying the invention is not limited to the embodiments described above, but may be implemented also in entirely different embodiments. In particular, other arrangements of filter elements to form a microwave filter are conceivable. The instant invention is in particular not limited to filters having a cul-de-sac topology.

LIST OF REFERENCE NUMERALS

1 Microwave filter
11 Housing
110-115 Housing wall
116 Elevation
12 Resonator element
120, 122 Opening
121 Top face
123 Shaft body
13, 14 Tuning element
130, 140 Nut
131, 141 Screw head
132, 142 Shaft
143 End piece
A1, A2 Adjustment direction
B Longitudinal direction
$C_{coupling}$ Coupling coefficients
C, C1-C6 Cavity
E Equivalent circuit
f Frequency F0 Resonant frequency
F, F1-F6 Resonant filter elements
L Output (load)
L1, L2 Length
M Main line
O32, O21, O16, O65, O54 Opening
P Symmetry plane
R0, R1 Frequency response
S Input (source)
Y1, Y2, Y3 Admittance

The invention claimed is:

1. A microwave filter, comprising at least one resonant filter element resonating at a resonant frequency, each resonant filter element comprising:

a housing;

a resonant filter cavity arranged in the housing; and a resonator element arranged in the housing, wherein at least two tuning elements are arranged on the housing of the resonant filter element and each extend into the cavity with a shaft portion, wherein the at least two tuning elements are movable with respect to the housing to adjust a length of the shaft portion extending into the housing, and wherein the at least two tuning elements are constituted and designed such that by adjusting the length of the shaft portion of each tuning element extending into the housing a temperature drift of the resonant frequency is adjustable, wherein the at least two tuning elements are arranged symmetrically with respect to the resonator element, wherein each of the at least two tuning elements extend from a housing wall into a respective opening of the resonator element, wherein each opening partially extends into a shaft body of the resonator element from a top face of the resonator element.

2. The microwave filter of claim 1, wherein, for each resonant filter element, a first of the at least two tuning elements, at a given adjustment position, has the effect of increasing the resonant frequency with increasing temperature of the microwave filter, whereas a second one of the at least two tuning elements, at a given adjustment position, has the effect of decreasing the resonant frequency with increasing temperature of the microwave filter.

3. The microwave filter of claim 1, wherein, for each resonant filter element, the at least two tuning elements are movable with respect to the housing independent of each other.

4. The microwave filter of claim 1, wherein, for each resonant filter element, the at least two tuning elements are made of a metallic material or a dielectric material.

5. The microwave filter claim 1, wherein, for each resonant filter element, the at least two tuning elements comprise a different material and/or shape.

6. The microwave filter claim 5, wherein, for each resonant filter element, the different materials comprise a different thermal expansion coefficient.

* * * * *